United States Patent [19]

Matsuda et al.

[11] 4,254,821

[45] Mar. 10, 1981

[54] HEAT PIPE DEICING APPARATUS

[75] Inventors: Seigo Matsuda, Wayland; Gabor Miskolczy, Carlisle; John B. Dunlay, Wayland, all of Mass.

[73] Assignee: Thermo Electron Corporation, Waltham, Mass.

[21] Appl. No.: 65,493

[22] Filed: Aug. 10, 1979

[51] Int. Cl.[3] ..... F28D 15/00

[52] U.S. Cl. ..... 165/41; 165/51; 165/105; 165/47; 237/67; 440/89

[58] Field of Search ..... 165/47, 41, 51, 105; 115/73, 75

[56] References Cited

U.S. PATENT DOCUMENTS

| | | | |
|---|---|---|---|
| 3,195,619 | 7/1965 | Tippmann | 165/105 X |
| 3,217,791 | 11/1965 | Long | 165/105 X |
| 3,554,183 | 1/1971 | Grover | 165/105 X |
| 3,618,569 | 11/1971 | Baer | 165/106 X |
| 3,770,049 | 11/1973 | Wright | 165/41 |
| 3,837,311 | 9/1974 | Lea, Jr. | 165/105 X |
| 4,075,964 | 2/1978 | Sjogren | 165/41 X |
| 4,084,376 | 4/1978 | Asselman et al. | 165/105 X |
| 4,159,737 | 7/1979 | Biermann et al. | 165/105 |

FOREIGN PATENT DOCUMENTS

| | | | |
|---|---|---|---|
| 148565 | 2/1937 | Fed. Rep. of Germany | 237/67 |

*Primary Examiner*—Albert W. Davis

*Attorney, Agent, or Firm*—Herbert E. Messenger; James L. Neal

[57] ABSTRACT

A heat pipe deicing system is disclosed for preventing accumulation of ice on portions of structures such as the deck, handrails, and ladders of a fishing vessel operating in very cold oceans. The heat pipe includes an evaporator in contact with a source of heat such as exhaust gases of an engine, one or more condensers positioned above the evaporator to cover surfaces to be deiced, and an insulated transition section for transporting a heat transfer fluid between the evaporator and condenser. The transition section and condenser have legs arranged to provide multiple passageways which assure continuous gravity-assisted return flow of condensed heat transfer fluid to the evaporator and a high level of deicing capacity even during pitching and rolling of the structure on which the deicing system is installed.

6 Claims, 8 Drawing Figures

HEAT PIPE DEICING APPARATUS

BACKGROUND OF THE INVENTION

This invention relates to apparatus for preventing accumulation of ice on structures such as marine vessels.

Structures operating in extremely cold seas such as fishing vessels operating in northern oceans during the winter are likely to gather ice on their superstructure. The problem is especially serious in a strong wind and rough seas when sea water droplets or water splashes contact exposed portions of the upper structure of a vessel. At such times, rapid and extensive formation of ice on parts such as the deck, bridge, handrails, ladders, and deck machinery causes difficulties in operating and navigating the vessel and may cause it to capsize and be lost.

Known techniques for deicing marine structures include (1) spraying with hot water or sea water, (2) heating with electrical cables, and (3) laying rubber mat or sheets of foam material. However, methods (1) and (3) generally yield insufficient effects, and method (2) requires too much electric power. A heater circulating liquid containing anti-freeze is another possible deicing device but would require a long heat-up time if kept off during idle periods or would have very high standby losses if kept warm continuously.

A further consideration in preventing the accumulation of ice on floating marine structures is that these structures are frequently subject to changes in angular orientation—for example, vessels may pitch and roll due to waves.

Accordingly, it is an object of the invention to provide improved apparatus for deicing structures.

It is a more particular object of the invention to provide apparatus for preventing the accumulation of ice on a vessel which can respond quickly and deliver heat efficiently to portions of the vessel requiring it.

It is also an object of the invention to provide heat pipe deicing apparatus for marine structures whose deicing capacity remains substantially unchanged even when the vessel is pitching and rolling.

SUMMARY OF THE INVENTION

The invention concerns improved apparatus for preventing accumulation of ice on structures comprising a source of heat and a novel heat pipe. The heat pipe has a heat transfer fluid such as ammonia sealed therein and also includes an evaporator in contact with the heat source, one or more condensers positioned above the evaporator and attachable to surfaces to be deiced, and an insulated transition section for transporting the heat transfer fluid between the evaporator and the condenser. The transition and condenser sections include a plurality of legs forming multiple passageways between the evaporator and the condenser. The multiple passageways assure adequate gravity-assisted return flow of condensed heat transfer fluid to the evaporator and a high continuous level of deicing capacity even when the heat pipe is tilted due to pitching and rolling of the marine structure.

One important use of preferred embodiments of the invention is in deicing parts such as the deck, handrails, and ladders of a fishing vessel operating in very cold oceans. To accomplish this, the condenser of the heat pipe is constructed in the shape of the portion of the vessel to be deiced-for example, as interconnected members forming a horizontal planar section for deicing a deck or as a vertical section for deicing a handrail. The condenser is attached to the selected part of the vessel superstructure and heat is applied to the evaporator from a source such as the exhaust gases of an internal combustion engine. The vaporized heat transfer fluid flows through the transition section to the condenser where it condenses, releasing heat to melt ice. The condensate then returns to the evaporator through the multiple passageways under the influence of gravity and by capillary action of a wick lining the inner wall of at least the evaporator section of the heat pipe.

DETAILED DESCRIPTION OF PREFERRED EMBODIMENTS OF THE INVENTION

Figure 1:
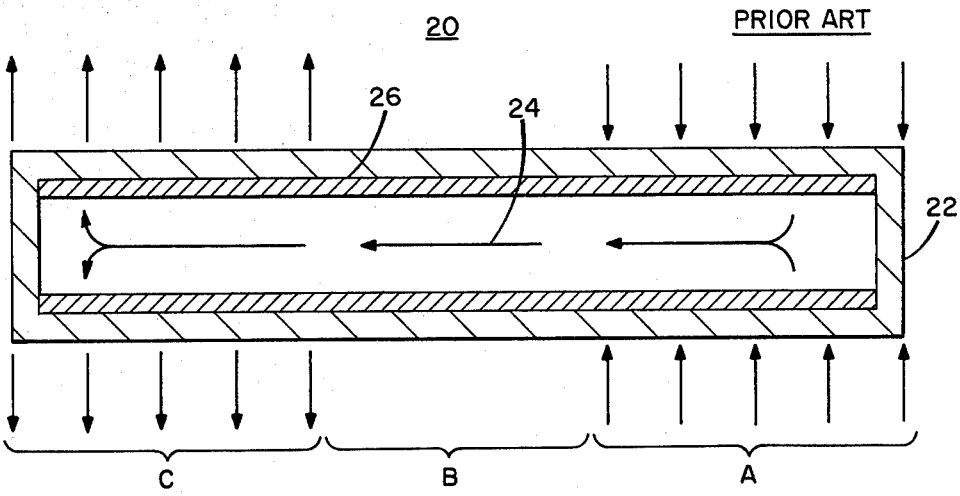
FIG. 1 is a side view in cross-section of a cylindrical heat pipe of known form illustrating the transfer of heat to and from a heat pipe.

FIG. 1 is a cross-sectional view of a cylindrical heat pipe 20 and illustrates certain basic operating principles of a heat pipe. A small quantity of a heat transfer fluid such as water, ammonia, alcohol or fluorocarbon compound is sealed within a container 22. When heat is applied to the evaporator A of the heat pipe 20, the fluid is vaporized. The vaporized heat transfer fluid moves along the pipe 20 in the direction indicated by the arrows 24 through an insulated transition section B to a condenser C. At the condenser C the vaporized fluid condenses to liquid form, releasing its latent heat. The liquid then returns to the evaporator A by passing through the pores of a wick 26 which lines the inner wall of the container 22. The wick 26, which may, for example, be made of wire screen or sintered metal, develops capillary forces which assist in returning the liquid to the evaporator A.

If the evaporator A of the heat pipe 20 is positioned lower than the condenser C, the return flow of the liquid is aided by gravity in addition to the wick 26. Thus if the heat pipe 20 were mounted in a horizontal position on the superstructure of a vessel, pitching and rolling of the vessel would at times aid in return of the condensed liquid to the evaporator A and at other times would hinder this flow. The effectiveness of the heat pipe would vary resulting in danger of excess ice accumulating on the vessel. Similar variable performance would result if the heat pipe 20 were bent to produce a horizontal condenser and vertical transition and evaporator sections.

Figure 2:
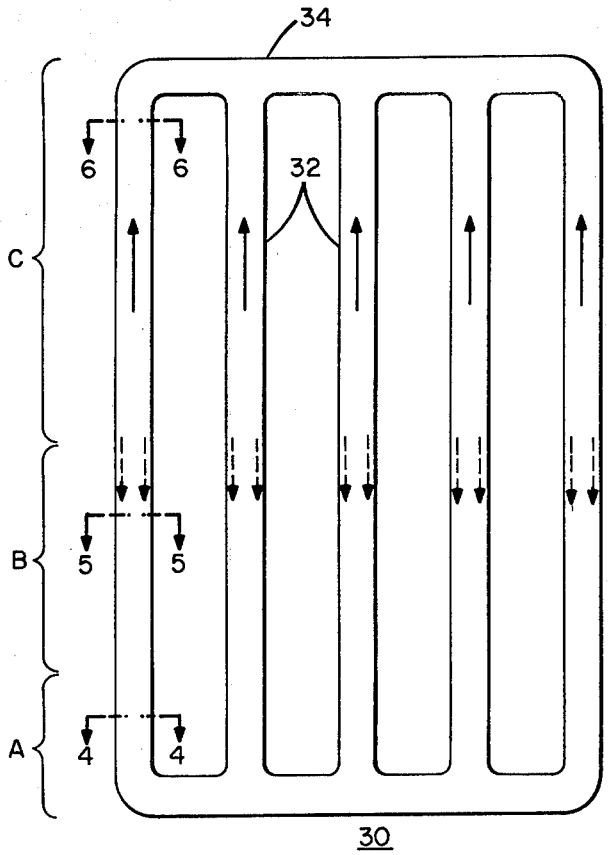
FIG. 2 is a side view of a heat pipe illustrating an embodiment of the invention useful for deicing a handrail or other vertical portion of a structure.
Figure 3:
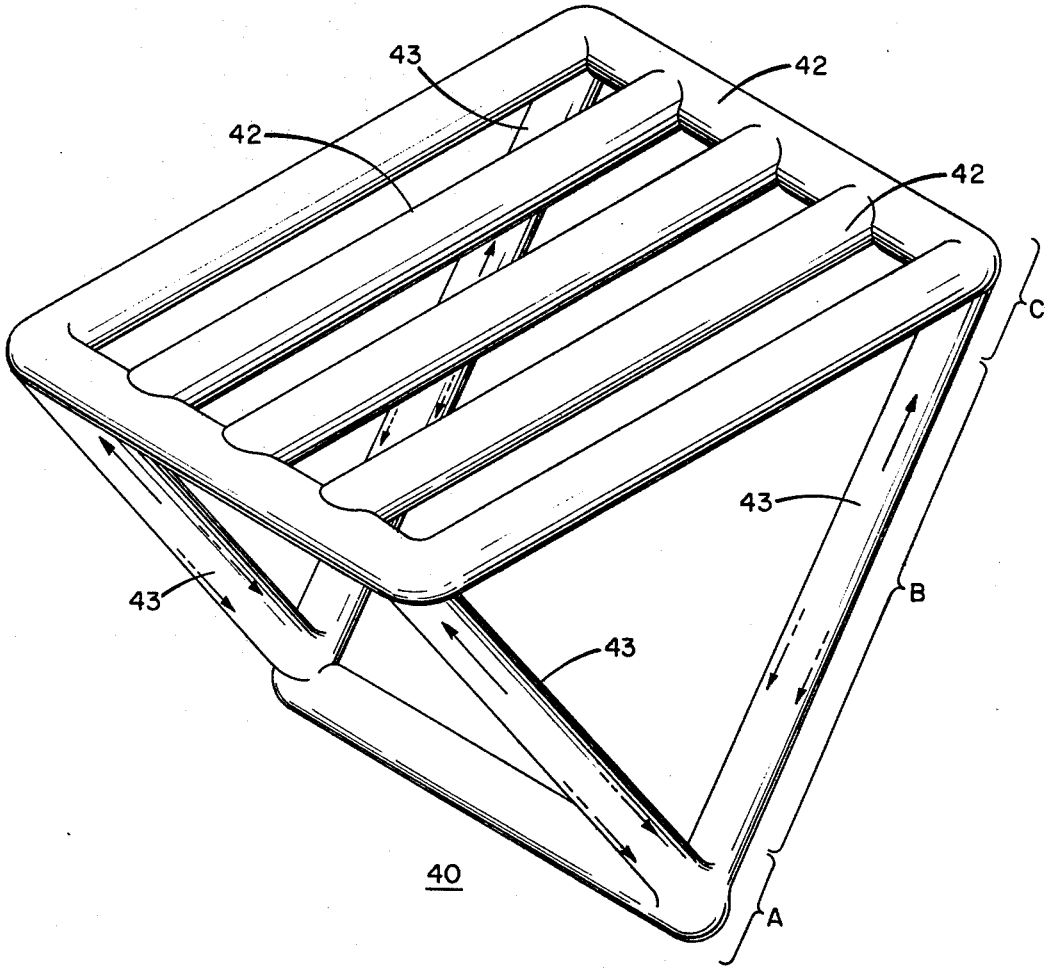
FIG. 3. is a view in perspective of a heat pipe illustrating an embodiment of the invention useful for deicing a deck or other horizontal portion of a structure.

Heat pipes according to preferred embodiments of the present invention are shown in FIG. 2 and FIG. 3. The heat pipes 30 and 40 illustrated therein include an evaporator A, an insulated transition section B, and a condenser C. Sealed within the heat pipes is a heat transfer fluid, preferably ammonia, but, alternatively methyl chloride or any other fluid which possesses suitable heat transfer and vapor pressure characteristics.

The evaporators A of the heat pipes 30 and 40 are intended for installation below the deck of a vessel which employs the deicing apparatus. Each evaporator preferably includes a wick (see FIG. 4) such as small metallic spheres bonded to the inner wall of the evaporator. Heat for vaporizing the heat transfer fluid within the evaporators A may be provided by combustion of fuel such as gas or oil in a burner or may be obtained from the exhaust of an internal combustion engine or other powerplant in the vessel (see FIG. 8).

The condensers C of the heat pipes 30 and 40 are attachable to parts of the vessel to be deiced and are shaped to cover major surface areas of these parts. Thus the condenser A of the heat pipe 30 comprises a plurality of vertical legs 32 joined by a horizontal top member 34 to form a condenser C of substantially vertical planar form which is useful for deicing a handrail, ladder, or other upright part of a vessel. The condenser C of the heat pipe 40 includes several elongated members 42 interconnected to form a substantially horizontal planar section useful for deicing a deck or other horizontal portion of a vessel.

The insulated transition section B of a heat pipe such as the heat pipes 30 and 40 connects the evaporator A and condenser C and transports vaporized heat transfer fluid to the condenser C and condensed heat transfer fluid to the evaporator A. Suitable insulation (not shown) such as glass fiber material is provided around the outer walls of the transition section B so that substantially no heat flows into or out of this section.

Figure 4:
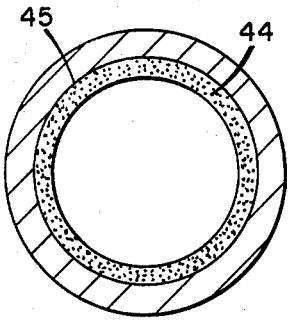
FIGS. 4–6 are cross-sectional views taken along the lines 4—4, 5—5, and 6—6 of the heat pipe of FIG. 2 showing the internal structure of, respectively, an evaporator, a transition section, and a condenser of a preferred heat pipe of the invention.
Figure 5:
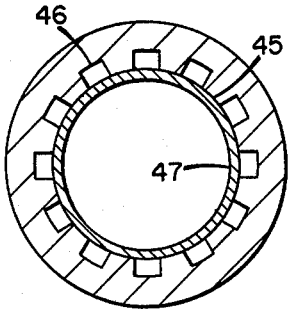
Figure 6:
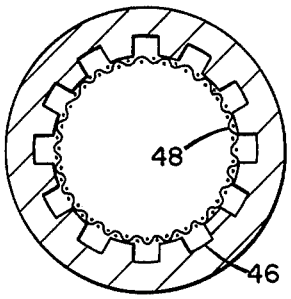

A preferred structure for the heat pipes of the present invention is illustrated in FIGS. 4–6, which show cross sections of the evaporator A, transition section B, and condenser C taken along lines 4—4, 5—5, and 6—6 of the heat pipe 30. The evaporator A contains a microsphere wick 44 comprising a matrix of small metal spheres bonded to the inner wall 45 of the heat pipe. The wick 44 may extend a small distance up into the transition section B. In the remainder of the transition section B, a plurality of grooves 46 extend axially along the inner wall 45. The grooves 46 are covered with a metal foil 47 which helps to channel condensed heat transfer fluid back to the evaporator A. The grooves 46 extend through the condenser section C (FIG. 6) where they are covered with a screen or woven metal mesh 48. The mesh 48 prevents entrainment of droplets of condensate by vapor flowing up through the inner portion of the heat pipe and also helps distribute condensate among the grooves 46.

An important aspect of the present invention is the provision of multiple passageways to assure gravity-assisted return of the heat transfer fluid to the evaporator A from the condenser C. The multiple passageways are formed by a plurality of legs such as the vertical legs 32 which make up the transition section B and part of the condenser C of the heat pipe 30 or the pairs of legs 43 which form two V-shaped sections in the heat pipe 40. These multiple passageways facilitate return of the condensed heat transfer fluid to the evaporator A under the influence of gravity even if the heat pipe 30 (or 40) tilts due to pitching and/or rolling of the vessel.

Figure 7:
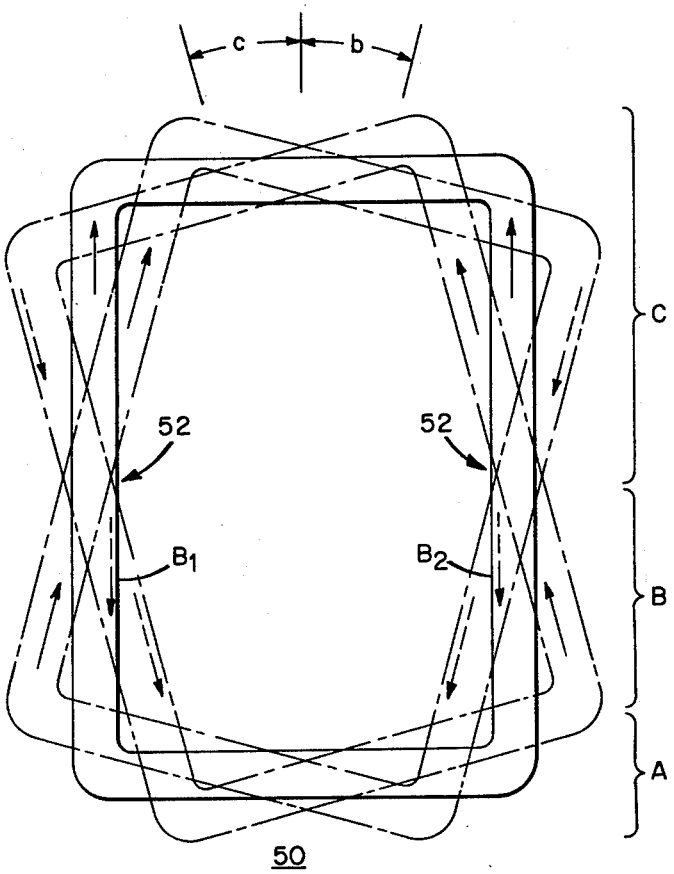
FIG. 7 is a side view of a heat pipe according to the invention showing the flow of heat transfer fluid for different angular orientations of the heat pipe.

FIG. 7 illustrates the flow of heat transfer fluid through a heat pipe 50 having two substantially vertical legs 52 during deicing operations wherein the heat pipe 50 tilts due to pitching or rolling of the marine structure in which the heat pipe 50 is installed. When the heat pipe 50 tilts to a position indicated by the angle b from vertical, the vaporized heat transfer fluid readily passes from the evaporator A through both insulated transition sections $B_1$ and $B_2$ to reach the condenser C. After the fluid condenses and transfers heat to those portions of the vessel to which it is attached, thus melting ice or preventing its formation, the condensate returns to the evaporator A primarily by passing through the transition section $B_2$. By contrast, when the heat pipe is tilted by the angle c from vertical, the condensate returns primarily through the section $B_1$. Since the cyclic movement of heat transfer fluid continues at a nearly constant rate regardless of changes in angular orientation of the heat pipe 50, its deicing capacity remains essentially undiminished even when the vessel pitches and rolls.

Figure 8:
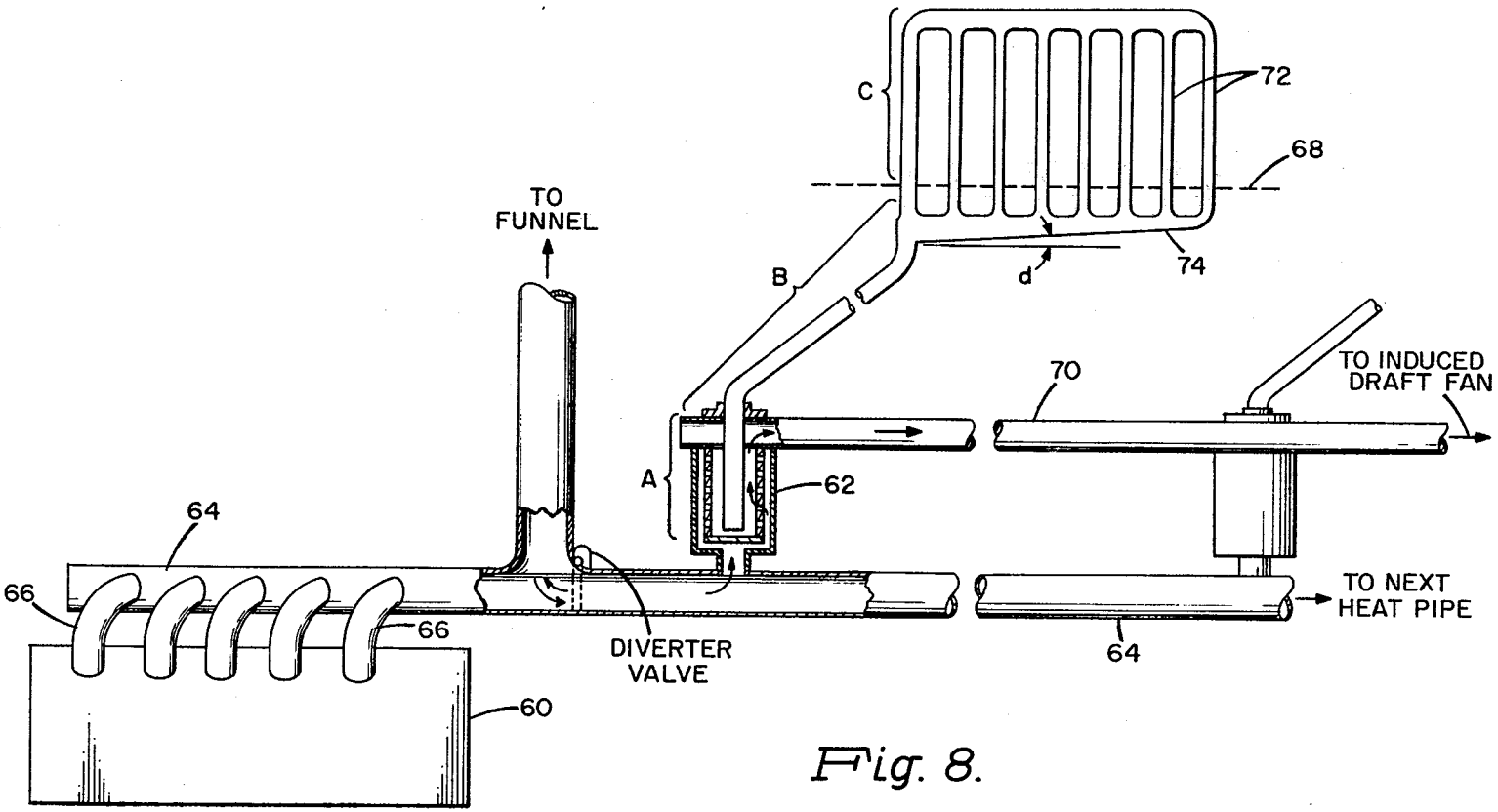
FIG. 8 is a side view, with portions broken away to expose internal details, of a portion of a heat pipe deicing apparatus powered by exhaust gases from an engine.

FIG. 8 shows an arrangement wherein the evaporator A of a heat pipe deicing apparatus exchanges heat with exhaust gases from an internal combustion engine 60 such as is used to power a marine vessel. A heat exchanger 62 surrounds the evaporator A and is supplied with hot gases by means of a duct 64 connected to the exhaust pipes 66 of the engine 60. In the heat exchanger 62, gases are directed into contact with the evaporator A to vaporize heat transfer fluid therein. The vaporized fluid passes through an insulated transition section B to the condenser C where it releases heat to melt ice on parts of the vessel above its deck 68, then returns to the evaporator A. Spent gases are exhausted through a duct 70 which may, if required, be attached to an induced draft fan (not shown). To allow gravity-assisted return of the condensed heat transfer fluid during pitching or rolling of the vessel, the condenser C and a portion of the transition section B include legs 72 defining multiple passageways, and the surface 74 of the transition section B is inclined at an angle d from horizontal which exceeds the maximum likely list of the vessel.

What is claimed is:

1. Apparatus for preventing accumulation of ice on a structure comprising: a source of heat; and a heat pipe for transferring heat from said source to portions of said structure to be deiced, said heat pipe having a heat transfer fluid sealed therein and comprising:

an evaporator in contact with said source of heat for vaporizing said heat transfer fluid;

at least one condenser positioned above said evaporator and attachable to portions of said structure to be deiced, said condenser operable to condense said heat transfer fluid and to transfer heat to said portions to be deiced; and insulated transition means connecting said evaporator and said condenser for transporting vaporized heat transfer fluid to said condenser and condensed heat transfer fluid to said evaporator;

said transition means and said condenser including a plurality of legs each providing a separate passageway between said condenser and said evaporator, said passageways assuring adequate gravity-assisted transport of said condensed fluid to said evaporator during operation of said apparatus at different angular orientations.

2. Apparatus as in claim 1 wherein said structure is a vessel powered by an internal combustion engine and said source of heat comprises at least a portion of the exhaust gases from said engine.

3. Apparatus as in claim 1 further including a wick contained in said evaporator and in at least a portion of said transition means for assisting in transport of condensed heat transfer fluid to said evaporator.

4. Apparatus as in claim 1 wherein said heat transfer fluid comprises ammonia.

5. Apparatus as in claim 1 wherein said structure is a marine vessel and said condenser comprises a plurality of interconnected elongated members forming a substantially horizontal planar section attachable to horizontal portions of said vessel, said members having interconnected ends permitting circulation of said heat transfer fluid throughout said planar section for deicing of said horizontal vessel portions; and said legs which provide separate passageways between said condenser and said evaporator are arranged to form a plurality of V-shaped sections.

6. Apparatus as in claim 1 wherein said condenser further comprises a substantially horizontal member connected to each of said legs to form therewith a planar section in the shape of at least a portion of a handrail of said structure.

* * * * *